United States Patent [19]

Kruger et al.

[11] Patent Number: 4,941,570

[45] Date of Patent: Jul. 17, 1990

[54] WRENCH SOCKET DISPENSER

[75] Inventors: Kurt J. Kruger, Milford; John T. Loechner, Westport, both of Conn.

[73] Assignee: Easco Hand Tools, Inc., Hunt Valley, Md.

[21] Appl. No.: 340,215

[22] Filed: Apr. 19, 1989

[51] Int. Cl.[5] ..... B65D 83/02; B65D 43/20

[52] U.S. Cl. ..... 206/267; 206/376; 220/350; 221/91

[58] Field of Search ..... 220/350; 221/91, 155; 206/378, 267, 377, 376, 375, 372, 374, 380, 379

[56] References Cited

U.S. PATENT DOCUMENTS

| | | | |
|---|---|---|---|
| 498,455 | 5/1893 | Bartlett | 206/379 |
| 2,000,162 | 5/1935 | Buscham | 206/267 |
| 2,792,934 | 5/1957 | Rocchetti | 206/379 |
| 4,162,024 | 7/1979 | Shamley | 220/350 |
| 4,222,486 | 9/1980 | Roth et al. | 206/379 |
| 4,351,435 | 9/1982 | Elwert et al. | 220/350 |
| 4,465,187 | 8/1984 | Kinard et al. | 220/350 |

*Primary Examiner*—Paul T. Sewell
*Assistant Examiner*—Jacob K. Ackun, Jr.
*Attorney, Agent, or Firm*—Leonard Bloom

[57] ABSTRACT

This invention to a case for storing and dispensing sockets from matching grooves. A desired socket can be visually selected through at least one of transparent end pieces which close opposite ends of the grooves. The desired socket can be dispensed by positioning a belt which wraps around the grooves to retain the socket therein, to bring an aperture opposite the groove matching the desired socket.

6 Claims, 3 Drawing Sheets

WRENCH SOCKET DISPENSER

FIELD OF THE INVENTION

This invention relates to a case having a slidable, apertured belt for storing and dispensing wrench sockets.

BACKGROUND OF THE INVENTION

Cases for storing and dispensing articles such as cigarettes and drill bits are known in the art.

U.S. Pat. No. 1,955,835 to Samstag teaches the use of separate, unconnected, uni-motional members to provide closure for a cigarette or like container.

U.S. Pat. No. 2,000,162 to Buscham discloses a cigarette or like case having an articulated, slidable closure.

U.S. Pat. No. 2,030,992 to Keller discloses a cigarette or like case having a closure comprising interconnected, U-shaped, metallic units which form a flexible curtain.

U.S. Pat. No. 2,078,665 to Horsley teaches the use of beads or ridges to hold a cigarette in an upright position within a case with a flexible sliding closure.

U.S. Pat. No. 4,222,486 to Roth et al. discloses a cylindrical container for storing drill bits in a spiral arrangement of bores to permit the removal of a desired bit.

U.S. Pat. No. 4,351,435 to Elwert et al. discloses a magazine for protected storage and selective withdrawal of drills arranged in individual pockets.

SUMMARY OF THE INVENTION

Briefly stated, this invention relates to a case for storing wrench sockets wherein the case has at least one transparent end piece for viewing the stored sockets to select a desired socket for dispensing.

In accordance with an embodiment of this invention, the case stores sockets in parallel grooves which are integral with a base and are sized and shaped to match respective sockets. The grooves are separated by curved side walls which have heights sufficient to laterally retain the sockets. A pair of oblong end pieces close opposite ends of the grooves to further retain the sockets therein. The oblong end pieces include slots located about their periphery which face each other when the oblong end pieces are fastened to the base. At least one of the oblong end pieces is transparent, enabling viewing of the stored sockets. A belt having sides slidably mounted within the slots wraps around the base and the curved side walls to retain the sockets in their matched grooves. The belt includes an aperture to permit ingress and egress of a desired socket.

In operation, the desired socket is dispensed by selectively positioning the belt's aperture opposite the matched groove containing the desired socket.

It is an object of this invention to provide a case for storing and dispensing sockets which enables viewing of the stored sockets to select a desired socket for dispensing.

These and other objects of the invention will become more apparent from the following detailed description of an embodiment when considered in conjunction with the accompanying drawings and appended claims.

DETAILED DESCRIPTION OF THE INVENTION

Figure 1:
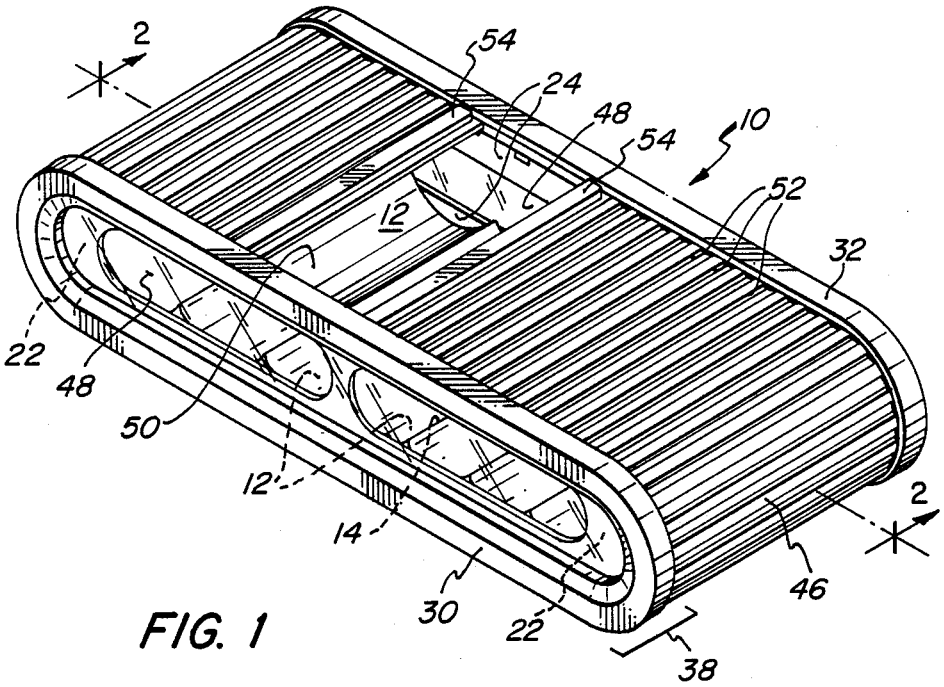
FIG. 1 is a perspective end view of an embodiment of a case in accordance with this invention.

With reference to FIGS. 1–5 and especially FIG. 1, a case 10 in accordance with this invention is shown. Case 10 comprises a number of grooves 12 which are sized and shaped to receive and partially enclose respective sockets (not shown) or other articles. Grooves 12 lie in a parallel row separated by curved side walls 14 which rise to a height sufficient to laterally retain respective sockets in their matched grooves 12.

Figure 2:
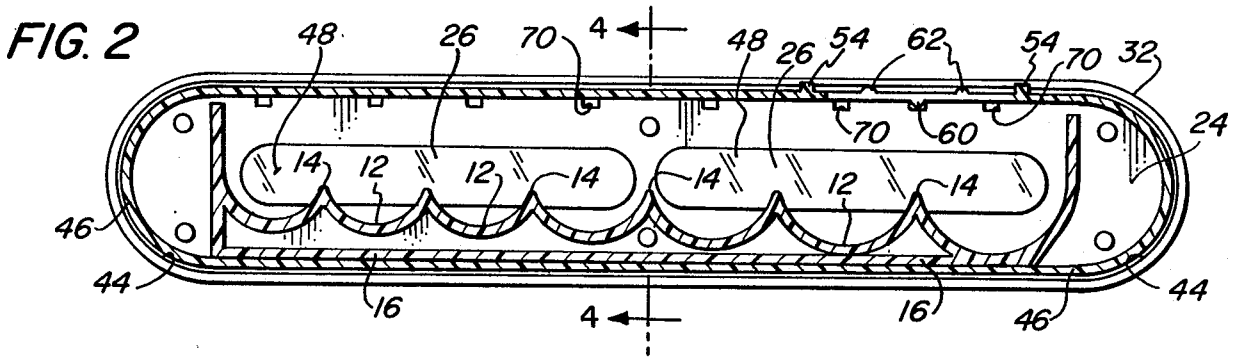
FIG. 2 is an enlarged cross-sectional end view of the case in FIG. 1.

Referring now to FIG. 2, grooves 12 separated by curved side walls 14 are shown as an integral part of a base 16. Base 16 and integral curved side walls 14 are fastened to oblong end plates 22 (see FIGS. 1 and 3) and 24 to close opposite ends of grooves 12 and thereby further retain sockets therein. Fastening may be obtained for example by gluing or heat bonding. Oblong end plates 22 and 24 are provided as transparent to enable viewing of stored sockets for selection of a desired socket. Viewing may be accomplished by providing oblong end plates 22 and 24 with viewing holes 26 (see FIGS. 1 and 3) and 28 respectively, or by forming oblong end plates 22 and 24 of transparent material.

Figure 3:
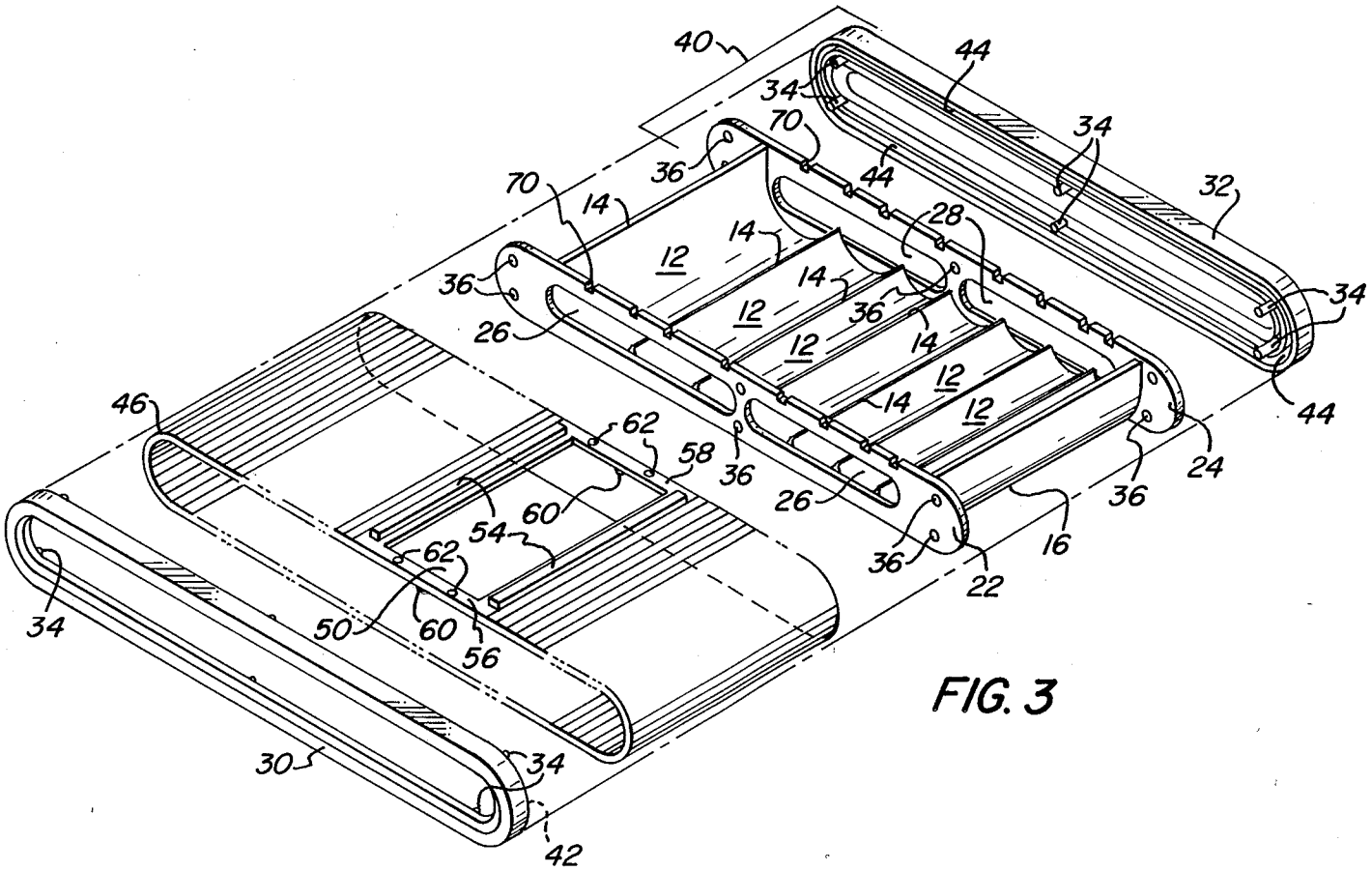
FIG. 3 is an exploded end perspective view of the case in FIG. 1.

Referring now to FIG. 3, the assembly of case 10 is revealed in a partially exploded perspective end view. A completely exploded view would also reveal oblong end plates 22 and 24 separated from base 16 and integral walled grooves 12. Oblong end frames 30 and 32 are mounted, by fitting studs 34 into holes 36, respective oblong end plates 22 and 24 to form oblong end pieces 38 (see FIG. 1) and 40. Oblong end frames 30 and 32 each have respective slots 42 and 44 about their periphery which are oriented to face each other when oblong end frames 30 and 32 are mounted to respective oblong end plates 22 and 24.

A belt 46 is slidably mounted within slots 42 and 44 for wrapping around base 16 with integral curved side walls 14 to retain sockets in their matched grooves 12. Belt 46 includes an aperture 50 disposed therein for permitting ingress and egress of sockets to be stored or dispensed.

Figure 4:
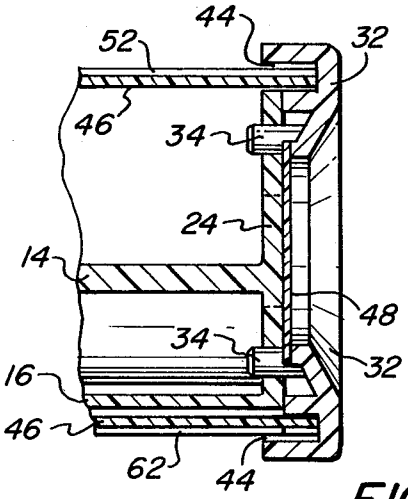
FIG. 4 is an enlarged partial cross-sectional view of the case in FIG. 1 taken along line 4—4 of FIG. 2.

Referring to FIG. 1 and 4, an enlarged cross-sectional view reveals how oblong end frames 32 are mounted to oblong end plates 24, and how belt 46 is slidably mounted within slots 44. Belt 46 preferably includes ribs 52 to provide a better gripping surface for selectively positioning aperture 50 opposite the matching groove 12 of the desired socket. A layer of transparent material 48, shown sandwiched between oblong end frame 32 and oblong end plate 24, may be provided to prevent dust and dirt from entering case 10 through viewing holes 26 and 28.

Returning to FIG. 3, two raised ribs 54 lie on either side of aperture 50 to further increase the ease with which aperture 50 may be selectively positioned to dispense the desired socket. Further, the region of belt 46 at ends 56 and 58 of aperture 50 have no ribs 52, rather they each have a detent bump 60 and a pair of pressing bumps 62. As aperture 50 is selectively positioned opposite the matched groove 12 of the desired socket, detent bumps 60 slip into one of a series of notches 70 on both oblong end plates 22 and 24. Notches 70 are centered at each groove 12 to movably lock belt 46 with aperture 50 in position to store or dispense the desired socket.

Figure 5:
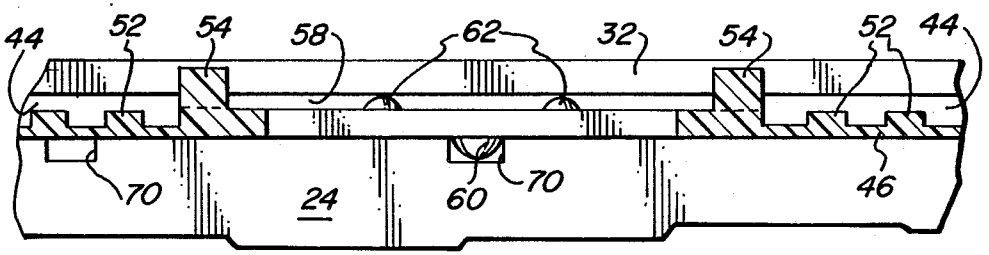
FIG. 5 is an enlarged cross-sectional end view of the detent arrangement of the case in FIG. 1.

Referring to FIG. 5, an enlarged view of detent bump 60 within notch 70 is shown. Pressing bumps 62 serve to push detent bump 60 within successive notches 70 because slot 44 is not wide enough to easily accomodate all three bumps.

In operation, the desired socket would be visually selected by viewing through transparent end pieces 38 and 40. Belt 46 would be positioned with the aid of ribs 52 and raised ribs 54 to bring aperture 50 opposite groove 12 which matches the desired socket. Detent bumps 60 would slip into notches 70 with the aid of pressing bumps 62 to movably lock belt 46 into position for dispensing the desired socket.

The above description is for the purpose of teaching a person skilled in the art how to make and use the invention. This description is not meant to describe in detail each and every modification or variation which will be apparent to the skilled worker; however, it is meant to include all such modifications and variations within the scope of the following claims.

What is claimed is:

1. A case for storing and selectively dispensing socket members for use with a universal socket wrench comprising:

A. a substantially continuous, unitary base comprising a plurality of elongated, parallel U-shaped grooves positioned in a side-by-side relationship, each of said elongated grooves having
   a. a size and shape for receiving and holding one of said socket members,
   b. sidewalls defined by said U-shape for separating said grooves, with said sidewalls being sufficient in height to laterally retain the socket members stored therein,
   c. first and second open zones formed at each end of each elongated groove, and
   d. a third, elongated open zone extending the entire length of each elongated groove, defined by the opening of said U-shape and enabling the socket members stored therein to be laterally removed and replaced in its entirety rapidly and efficiently;

B. a belt incorporating a single aperture zone which comprises a size and shaped substantially equal to the size and shape of the third open zone of the grooves of the base; and C. at least two end pieces, each being
   a. constructed for mounting to one side edge of said base for closing the first and second open zones thereof and preventing axial, longitudinal withdrawal of said socket member from said groove, and
   comprising a belt receiving slot formed therein, positioned in juxtaposed spaced, facing cooperating relationship with the slot of the opposed end piece, defining a belt receiving track enabling the movement of the belt relative to the base whereby the aperture zone of the belt is selectively positionable into overlying, juxtaposed, spaced relationship with any one of said elongated grooves, providing rapid and efficient ingress and egress of the socket member positioned within said groove.

2. The case in accordance with claim 1 further comprising detent means operative between said belt's sides and said end pieces' slot for movably locking the belt in successive positions that place said belt's aperture opposite each of said plurality of parallel grooves.

3. The case in accordance with claim 2 wherein said end piece further comprise:

end plates fastened to said base for closing opposite ends of said matched grooves to retain said sockets therein, at least one of the end plates being transparent to enable viewing of sockets stored in matched grooves; and end frames mounted to said end plates, the end frames each having said slot located about its periphery and both being oriented so that the slots face each other for slidably mounting said belt's sides therein, the end frames further for framing said transparent end plate.

4. The case in accordance with claim 3 wherein said detent means further comprises:

a plurality of notches formed in an edge of at least one of said end plates, the plurality of notches each being substantially centered at one of said plurality of grooves;

at least one knob attached to said belt's sides, said knob for selective engagement with said notch to selectively locate said belt with said aperture opposite respective grooves; and means for pressing said knob into engagement with said notch, said pressing means attached to said belt's sides substantially opposite said knob.

5. A case for storing and selectively dispensing articles comprising:

A. a substantially continuous, unitary base comprising a plurality of elongated, parallel U-shaped grooves positioned in a side-by-side relationship, each of said elongated grooves having
   a. a size and shape for receiving and holding one of said articles,
   b. sidewalls defined by said U-shape for separating said grooves, with said sidewalls being sufficient in height to laterally retain the articles stored therein,
   c. first and second open zones formed at each end of each elongated groove, and
   d. a third, elongated open zone extending the entire length of each elongated groove, defined by the opening of said U-shape and enabling the article stored therein to be laterally removed and replaced in its entirety rapidly and efficiently;

B. a belt incorporating a single aperture zone which comprises a size and shape substantially equal to the size and shape of the third open zone of the grooves of the base; and C. at least two end pieces, each being
   a. constructed for mounting to one side edge of said base for closing the first and second open zones thereof and preventing axial, longitudinal withdrawal of said article from said groove, and
   b. comprising a belt receiving slot formed therein, positioned in juxtaposed spaced, facing cooperating relationship with the slot of the opposed end piece, defining a belt receiving track enabling the movement of the belt relative to the base whereby the aperture zone of the belt is selectively positionable into overlying, juxtaposed, spaced relationship with any one of said elongated grooves, providing rapid and efficient ingress and egress of the article positioned within said groove.

6. The case in accordance with claim 5 wherein said oblong end pieces further comprise:

oblong end plates fastened to said base for closing opposite ends of said matched grooves to retain said articles therein, at least one of said oblong end plates being transparent to enable viewing of sockets stored in matched grooves; and oblong end frames mounted to said oblong end plates, said oblong end frames having said slot located about its periphery and both being oriented so that the slots face each other for slidably mounting said belt's sides therein, the oblong end frames being further defined as constructed for framing said transparent oblong end plate.

* * * * *